US008199095B2

(12) United States Patent
Jung et al.

(10) Patent No.: US 8,199,095 B2
(45) Date of Patent: Jun. 12, 2012

(54) DISPLAY DEVICE AND METHOD FOR DRIVING THE SAME

(75) Inventors: Dongil Jung, Gyeongsangbuk-do (KR); Kyoung Hun Lee, Gyeongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 1160 days.

(21) Appl. No.: 11/603,668

(22) Filed: Nov. 22, 2006

(65) Prior Publication Data

US 2007/0242019 A1 Oct. 18, 2007

(30) Foreign Application Priority Data

Apr. 17, 2006 (KR) ..... 10-2006-0034612

(51) Int. Cl.
*G09G 3/36* (2006.01)

(52) U.S. Cl. ..... 345/98

(58) Field of Classification Search ..... 345/87, 345/94, 99, 204, 213, 60, 98
See application file for complete search history.

(56) References Cited

U.S. PATENT DOCUMENTS

| | | | | |
|---|---|---|---|---|
| 6,320,575 | B1 * | 11/2001 | Terashima et al. | 345/213 |
| 6,538,633 | B1 * | 3/2003 | Ito | 345/99 |
| 6,600,469 | B1 * | 7/2003 | Nukiyama et al. | 345/87 |
| 2004/0196242 | A1 * | 10/2004 | Jang et al. | 345/94 |
| 2005/0073516 | A1 * | 4/2005 | Kang | 345/204 |
| 2006/0055687 | A1 * | 3/2006 | Sheu et al. | 345/204 |

FOREIGN PATENT DOCUMENTS

| | | |
|---|---|---|
| CN | 1680995 A | 10/2005 |
| JP | 09-033891 | 2/1997 |
| JP | 11-085115 | 3/1999 |
| JP | 2003-207760 | 7/2003 |
| JP | 2005-037833 | 2/2005 |
| JP | 2006-047580 | 2/2006 |

OTHER PUBLICATIONS

Office Action issued in corresponding Chinese Patent Application No. 200610137110.8; issued Dec. 12, 2008.
Office Action issued in corresponding Japanese Patent Application No. 2006-318976; issued Mar. 16, 2010.

* cited by examiner

*Primary Examiner* — Quan-Zhen Wang
*Assistant Examiner* — Tony Davis
(74) *Attorney, Agent, or Firm* — Brinks Hofer Gilson & Lione

(57) ABSTRACT

A display device includes a display panel, a timing controller, a gate driver, a pulse width controller, and a data driver. The display panel has pixels divided by gate lines arranged in first direction and data lines arranged in second direction. The timing controller generates gate control signals and first source output enable signal. The gate driver provides gate lines with scan signals in response to gate control signals. The pulse width controller varies some of the pulse widths of the first source output enable signal to generate second source output enable signal. The data driver performs charge sharing on data lines based on the second source output enable signal so that pre-charge voltage is formed at data lines, and provides data lines with data voltages based on the second source output enable signal.

12 Claims, 8 Drawing Sheets

DISPLAY DEVICE AND METHOD FOR DRIVING THE SAME

BACKGROUND OF THE INVENTION

1. Priority Claim

This application claims the benefit of priority from Korean Application No. 2006-0034612 filed on Apr. 17, 2006, which is incorporated herein by reference.

2. Technical Field

The present invention relates to a display device and a method of driving a display device.

3. Related Art

In a liquid crystal display a liquid crystal material with an anisotropic dielectric constant is formed between an upper transparent insulating substrate and a lower transparent insulating substrate. Molecular arrangement of the liquid crystal material is changed by the intensity of the electric field applied to the liquid crystal material such that the amount of light transmitted through the transparent insulating substrates may be controlled, and thereby display a desired image. In the liquid crystal display, a thin film transistor liquid crystal display (TFT LCD) using a TFT as a switching device is generally used.

In FIG. 1 the liquid crystal display has a display panel 100, a gate driver 110, a data driver 120, a timing controller 130 and a gamma voltage supplier 140. The display panel 100 has a plurality of pixels formed at regions where gate lines GL1, GL2, . . . , and GLn and data lines DL1, DL2, . . . , and DLm intersect each other. The gate lines are arranged in a first direction, and the data lines are arranged in a second direction substantially perpendicular to the first direction. Thin film transistors respectively having a gate electrode, a source electrode, and a drain electrode arranged in regions where the gate lines and the data lines intersect. A liquid crystal capacitor Clc and a storage capacitor Cst are arranged in the respective pixel P. The liquid crystal capacitor Clc may be equivalent to a liquid crystal material. The storage capacitor Cst maintains voltage stored in the liquid crystal cell Clc.

The respective pixel P of the panel 100 displays an image based on scan signals provided through the gate lines GL1, GL2, . . . , and GLn and data signals provided through the data lines DL1, DL2, . . . , and DLm. A scan signal may represent a pulse having a gate high voltage supplied only during one horizontal period and a gate low voltage supplied during the remnant period. The thin film transistor of each pixel P is turned on when the gate high voltage is applied thereto, so that the data signals from the data line DL1, DL2, . . . , DLm are provided to the liquid crystal cells Clc through the turned-on thin film transistor TFT. Furthermore, when the gate low voltage from the gate line GL1, GL2, . . . , GLn is applied, the thin film transistor is turned off so that the data signal stored in the liquid crystal cell Clc is maintained.

The gate driver 110 sequentially provides a plurality of scan signals to the gate lines GL1, GL2, . . . , and GLn in response to the gate control signal from the timing controller 130. The data driver 120 transforms red pixel data, green pixel data and blue pixel data into data voltages in response to the data control signal from the timing controller 130, and supplies the data voltages to the data line DL1, DL2, . . . , and DLm. The data voltage may represent a gamma voltage, which is selected among the gamma voltages supplied from the gamma voltage supplier 140, corresponding to the red, green and blue pixel data (e.g., gray levels).

The timing controller 130 generates the gate control signals for controlling the gate driver 110 and the data control signals for controlling the data driver 120 based on the externally provided red, green and blue pixel data, a horizontal synchronization signal Hsync, a vertical synchronization signal Vsync, and a clock CLK. The gate control signals have a gate start pulse GSP, a gate shift clock GSC, a gate output enable signal GOE, etc. The data control signals have a source start pulse SSP, a source output enable signal /SOE, a polarity control signal POL, etc. The gamma voltage supplier 140 generates the gamma voltages, which corresponds to respective gray levels, and supplies the generated gamma voltages to the data driver 120. The gamma voltages are used for digital-to-analog conversion at the data driver 120.

When the panel 100 is driven, an inversion driving method is used to prevent degradation of the liquid crystal material, which inverses a polarity of the pixel. The inversion driving method is divided into a frame inversion method, a column inversion method and a dot inversion method. The inversion driving method has disadvantage that power consumption increases because of the periodic inversion of the polarity of the data voltage. Thus, a charge sharing method is used together with the inversion driving method to solve the disadvantage of the power consumption.

FIG. 2A is a schematic showing multiple switches, and FIG. 2B is a timing diagram showing of the charge sharing method. In the charge sharing method, data lines DL1, . . . , DLm receive voltages of which voltage level is between a data voltage of a positive polarity and a data voltage of a negative polarity, so that variation range of the voltage at the data lines DL1, . . . , DLm may not be too large.

In FIGS. 1 and 2B, the source output enable signal /SOE and the polarity control signal POL are transmitted from the timing controller 130 to the data driver 130. DP denotes a waveform of the data voltage outputted from the data driver 120 to the data lines DL1, . . . , DLm. At the low level period of the source output enable signal /SOE, switches SW1 of FIG. 2A are turned on, and data voltages of a positive polarity are supplied to the data lines DL1, . . . , DLm such that panel 100 displays a predetermined image corresponding to the data voltages. At the high level period of the source output enable signal /SOE, switches SW2 of FIG. 2A are turned on, the data lines DL1, . . . , DLm are electrically connected to each other, so that the data lines DL1, . . . , DLm have an average level of the voltages supplied to the data lines DL1, . . . , DLm during the low level period of the previous source output enable signal /SOE. Hence, the data lines DL1, . . . , DLm have a voltage level between the data voltage of the positive polarity and the data voltage of the negative polarity.

Afterwards, when the high level period of the source output enable signal /SOE is changed to the low level period of the source output enable signal /SOE, the data voltages of the negative polarity are applied to the data lines DL1, . . . , DLm such that the panel 100 displays an image corresponding to the data voltages. Variation in the range of the voltages at the data lines DL1, . . . , DLm may be minimized because the voltages of the data line DL1, . . . , DLm have a voltage level that lies between the data voltage of the positive polarity and the data voltage of the negative polarity. Thus, the power consumption may be diminished.

After the panel 100 displays the image according to the data voltages of the negative polarity, the source output enable signal /SOE is changed to the high level. In case that the source output enable signal /SOE is changed to the high level, the data lines DL1, . . . , DLm have the average level of the voltages supplied to the data lines DL1, . . . , DLm during previous period (the low level period of the source output enable signal /SOE). Hence, the data lines DL1, . . . , DLm maintain a voltage between the data voltage of the positive and the data voltage of the negative signal.

In some charge sharing methods, the source output enable signal /SOE has a period during which the charge sharing is performed and a period during which the data voltages are provided to the data lines DL1, . . . , DLm. The time period during which the data voltages are applied to the data lines DL1, . . . , DLm is related with the image shown in the panel 100, ghost image, charging characteristics of the liquid crystal cell Clc, the generation of the heat at the data driver 120, and operation characteristics.

Therefore, some charge sharing methods may not provide an effective charge sharing method when the pulse width of the source output enable signal /SOE is fixed regardless of some factors (ghost image, charging characteristics of the liquid crystal cell Clc, the generation of the heat at the data driver 120, and operation characteristics, etc).

SUMMARY

A display device includes a display panel that has a plurality of pixels that are divided by a plurality of gate lines arranged in a first direction and a plurality of data lines arranged in a second direction. A timing controller generates at least one gate control signal and a first source output enable signal. A gate driver provides the gate lines with a plurality of scan signals in response to the gate control signal. A pulse-time modulation or a device that varies the duration of a pulse width, such as pulse width controller varies a pulse width of a first source output enable (first SOE) signal to generate a second source output enable signal (second SOE). The second source output enable signal may have a varied pulse width. The display device may further comprise a data driver that shares charges on the data lines based on the second SOE signal. The display device may be further configured to provide the data lines with a plurality of data voltages based on the second SOE signal.

A method drives a display device by generating a gate control signal and a first SOE. The method may occur through a plurality of gate lines of a display panel with a plurality of scan signals in response to the control signal. The method varies a pulse width of the first SOE signal to generate the second SOE signal that may vary the pulse width. The method performs a charge sharing on a plurality of data lines of the display panel based on the second source output enable signal. The charge sharing allows a pre-charge voltage to be reached at the data lines and provide the data lines with a plurality of data voltages based on the second source output enable signal.

BRIEF DESCRIPTION OF THE DRAWINGS

The invention can be better understood with reference to the following drawings and description. The components in the Figures are not necessarily to scale, emphasis instead being placed upon illustrating the principles of the invention. Moreover, in the Figures, like referenced numerals designate corresponding parts throughout the different views.

DETAILED DESCRIPTION OF THE PREFERRED EMBODIMENTS

Figure 1:
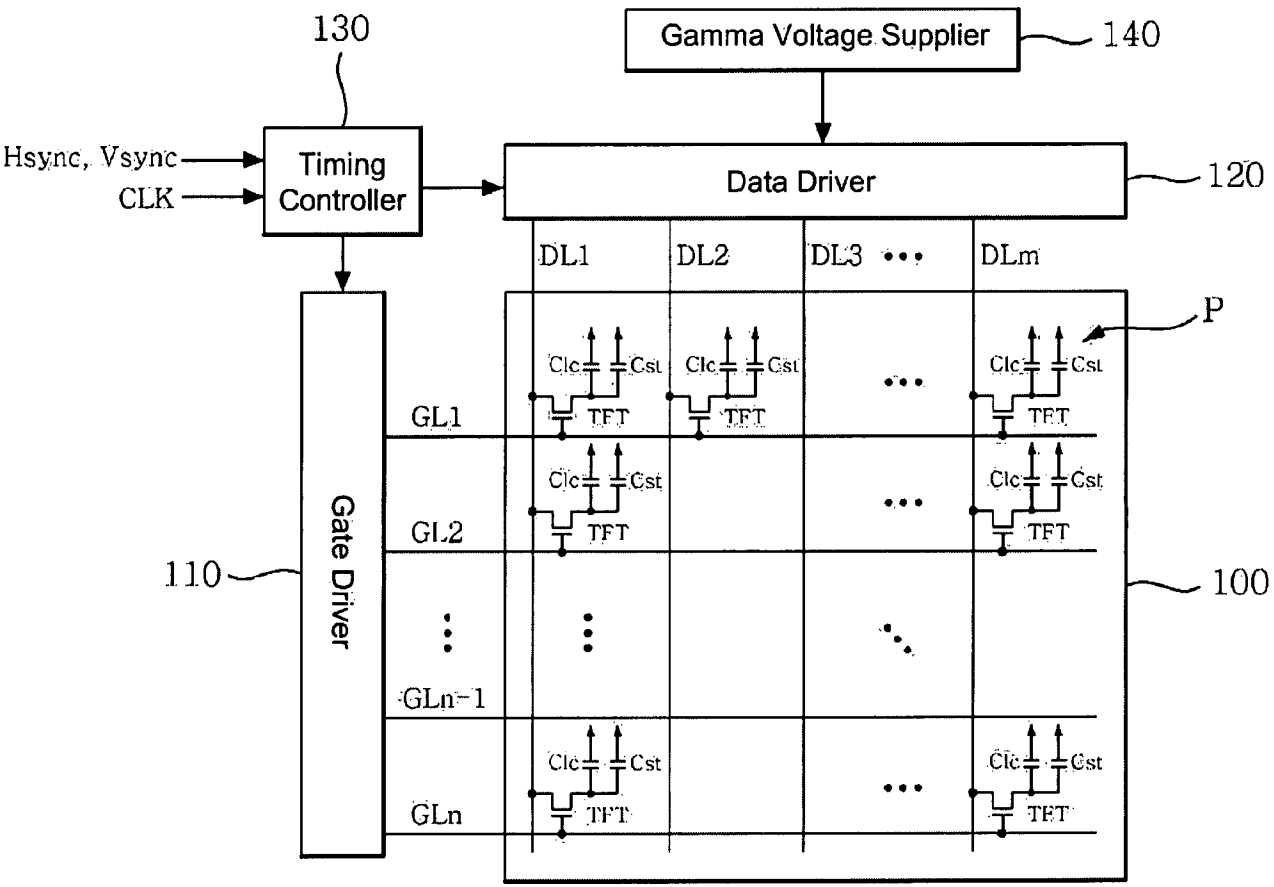
FIG. 1 (Related Art)
FIG. 1 is a schematic showing a liquid crystal display according to the related art.
Figure 2A:
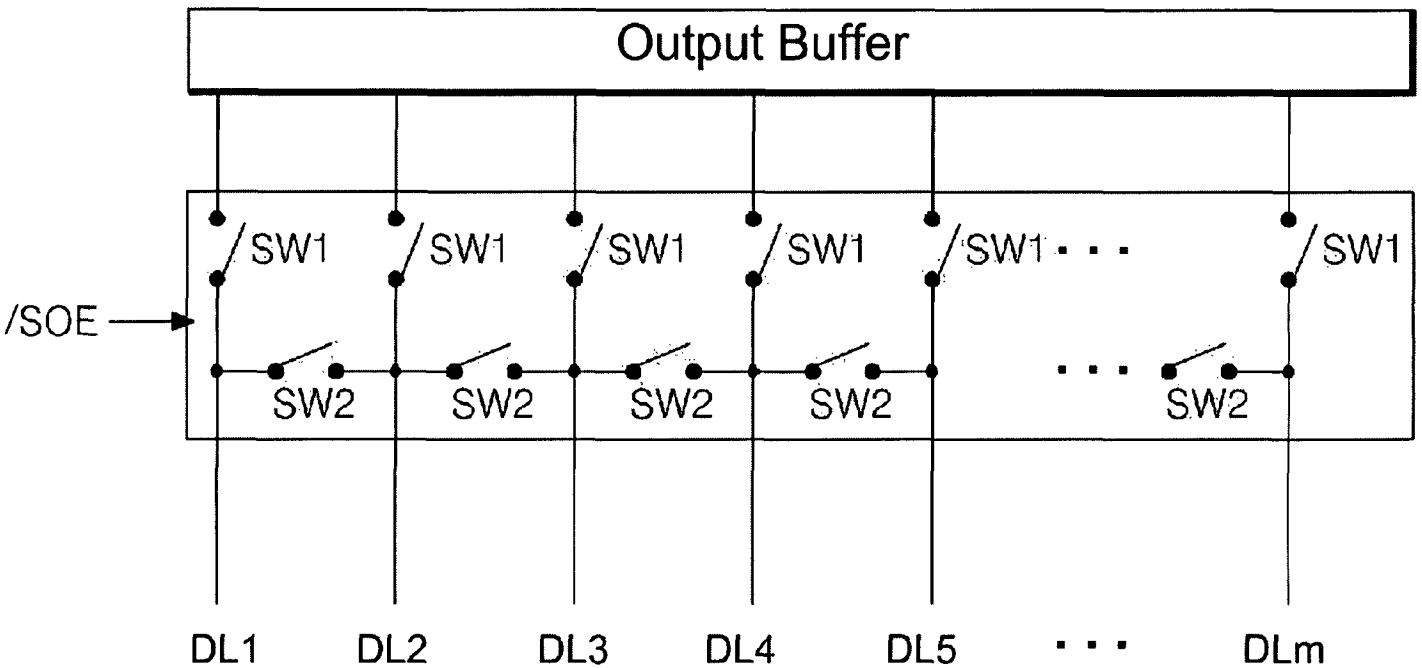
FIG. 2A (Related Art)
FIG. 2A is a schematic showing the charge sharing method.
Figure 2B:
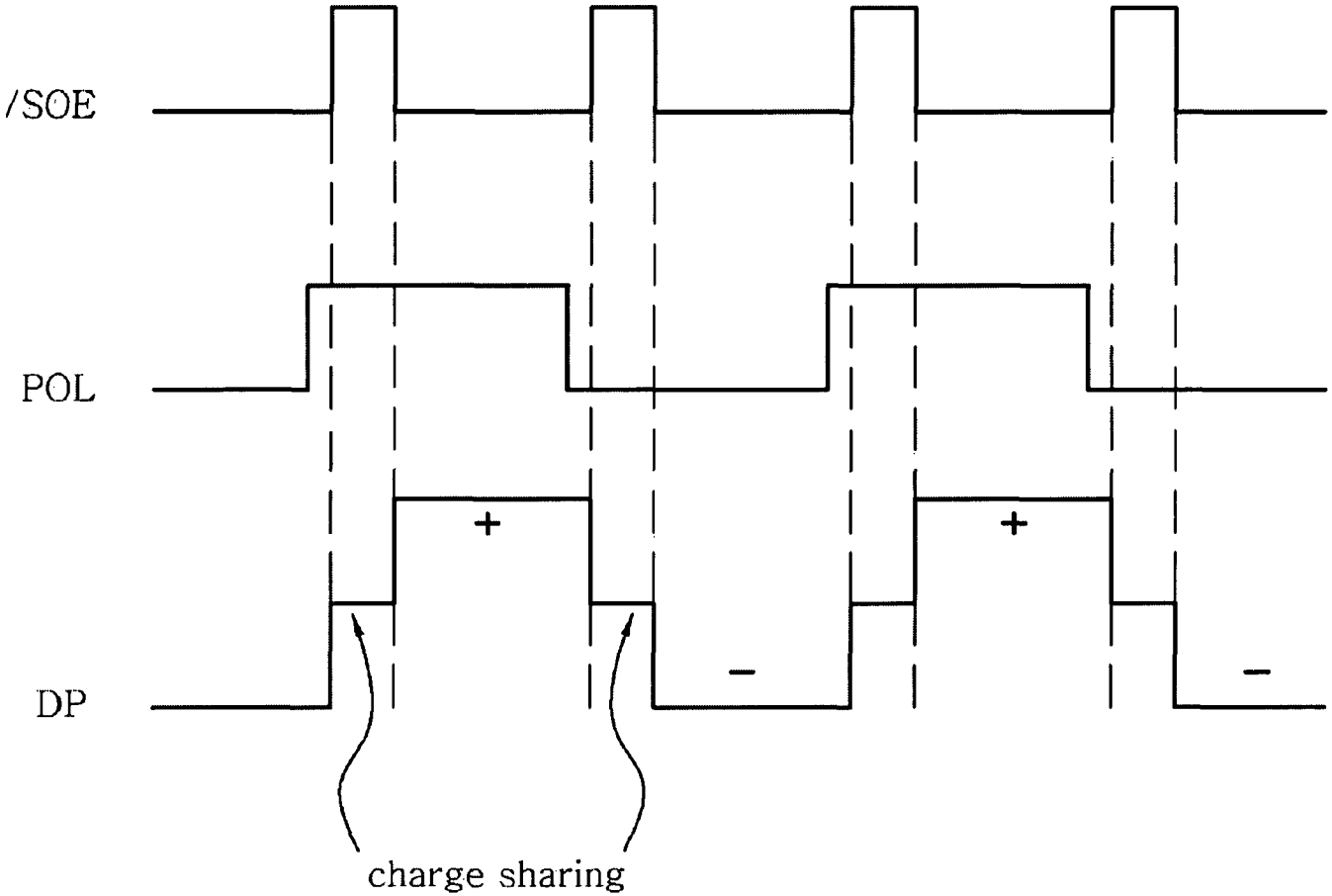
FIG. 2B (Related Art)
FIG. 2B is a timing diagram showing the charge sharing method.
Figure 3:
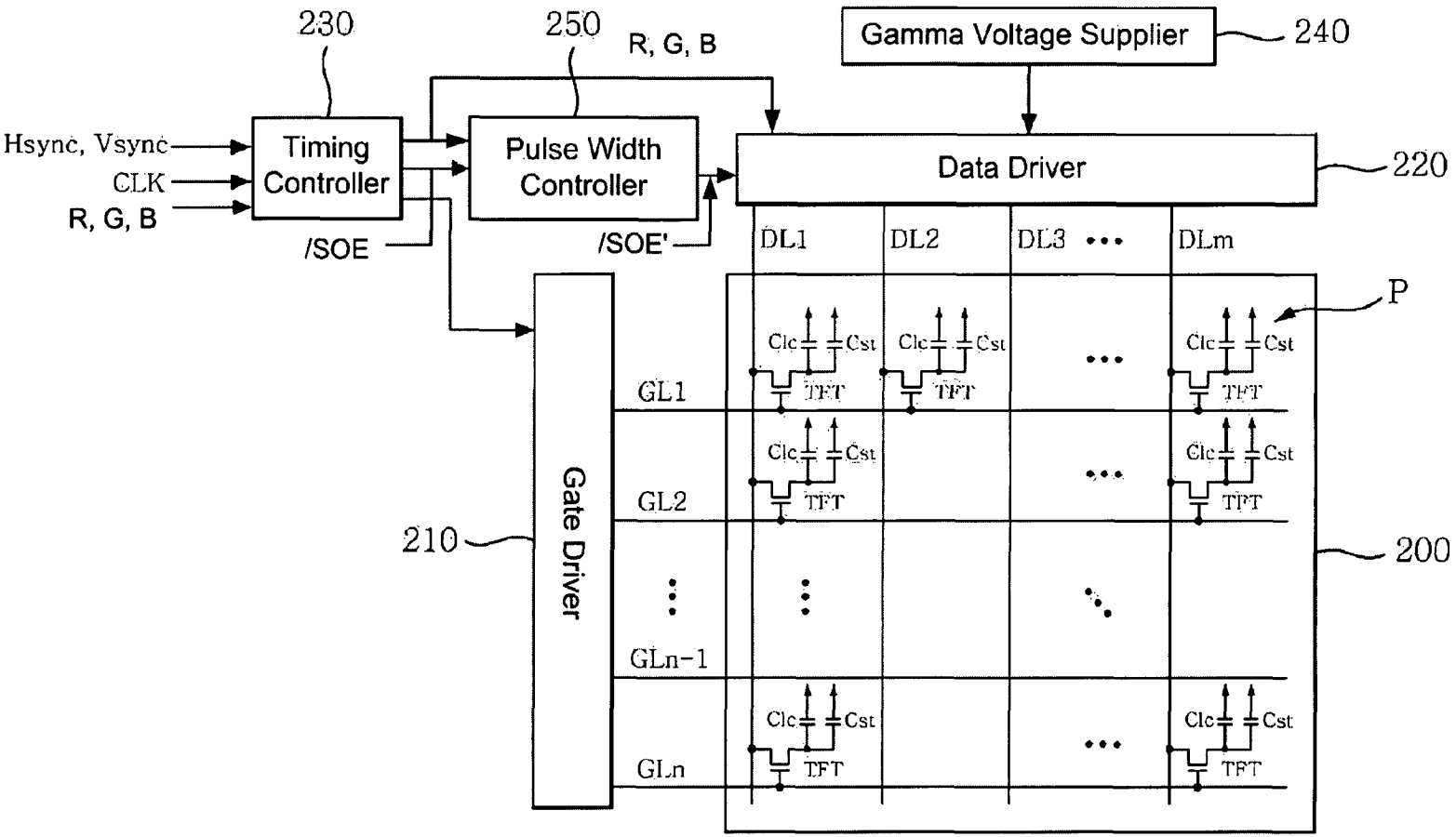
FIG. 3 is a schematic showing a liquid crystal display according to an embodiment.

In FIG. 3, a liquid crystal display has a display panel 200, a gate driver 210, a data driver 220, a timing controller 230, a gamma voltage supplier 240, and a pulse width controller 250. The display panel 200 includes an upper transparent insulating substrate and a lower transparent insulating substrate that face each other. A liquid crystal layer is interposed between the upper and lower transparent insulating substrates. A plurality of pixels are formed near regions where gate lines GL1, GL2, . . . , and GLn and data lines DL1, DL2, . . . , and DLm intersect. The gate lines are arranged in a first direction, and the data lines are arranged in a second direction that may be substantially perpendicular to the first direction. Thin film transistors may be positioned near regions where the gate lines and the data lines intersect.

Some thin film transistors provide the liquid crystal capacitor Clc with the data voltages supplied from the data lines DL1, DL2, . . . , and DLm in response to the scan signals supplied from the gate lines GL1, GL2, . . . , and GLn. The gate electrodes of the thin film transistors are coupled to the gate lines GL1, GL2, . . . , and GLn, the source electrodes of the thin film transistors are coupled to the data lines DL1, DL2, . . . , and DLm, and the drain electrodes of the thin film transistors are coupled to the pixel electrodes of the liquid crystal capacitors Clc.

A common electrode faces the pixel electrode, and a common voltage Vcom is provided to the common electrode. A circuit element used to store charge such as storage capacitor Cst is coupled to the liquid crystal capacitor Clc. The storage capacitor may Cst substantially maintain the voltages charged at the liquid crystal capacitor Clc. The storage capacitor Cst may be formed between a liquid crystal capacitor Clc coupled to the k-th gate line and a liquid crystal capacitor Clc coupled to the (k−1)-th gate line, or alternatively, may be formed between the liquid crystal capacitor Clc coupled to the k-th gate line and a common storage line.

The gate driver 210 sequentially provides a plurality of scan signals to the gate lines GL1, GL2, . . . , and GLn in response to gate control signals transmitted from the timing controller 230. The gate control signals may control the thin film transistors formed at the pixels P. In FIG. 3 the gate driver 210 may include a shift register that generates the scan signals that may occur sequentially, and a level shifter that converts a voltage level of the scan signals into a voltage level. In some systems, the voltage level may be appropriate to charge the liquid crystal capacitor Clc.

The data driver 220 may comprise a plurality of integrated circuits or in the alternative, comprises separate circuits. The data driver 220 may transform red pixel data, green pixel data, and blue pixel data into data voltages in response to the data control signals in response to the signal received from the timing controller 230. In FIG. 3, the data driver 220 may charge some or all of the data lines DL1, DL2, . . . , and DLm to a pre-charge level and supply the data voltages to the data lines DL1, DL2, . . . , and DLm when the thin film transistors are turned on.

In some systems, the data driver 220 may include a shift register, a register or a device to hold data, a latch, a digital-to-analog converter, a multiplexer, and an output buffer. In other systems, the data driver may include other circuits (e.g., a pulse width controller) or may include fewer circuits. The shift register shifts the red, green, and blue pixel data in response to a clock CLK and stores the red, green, and blue pixel data. The register may temporarily stores the red, green, and blue pixel data transmitted from the shift register. The latch stores the red, green, and blue pixel data transmitted from the register in a unit of a line in response to the clock CLK. The latch may simultaneously or substantially simultaneously transmit the stored red, green, and blue pixel data in a unit of a line. A digital-to-analog converter may select a gamma voltage level from more than one gamma voltages that have a positive polarity or a negative polarity based on the red, green, and blue pixel data transmitted from the latch. A circuit that selects a single output from multiple inputs such as a multiplexer may select one of the data lines DL1, DL2, . . . , and DLm to transmit data voltages based on selected gamma voltages. The output buffer is coupled between the multiplexer and the data lines DL1, DL2, . . . , and DLm.

In addition, the data driver 220 may further include a charge share circuit. The charge share circuit is coupled between the output buffer and the data lines DL1, DL2, . . . , and DLm, and may perform the charge sharing on the data lines DL1, DL2, . . . , and DLm. The charge share circuit may allow a pre-charge voltage to be reached at the data lines DL1, DL2, . . . , and DLm. A charge share circuit may maintain the variation range of the voltage at the data lines DL1, . . . , DLm so that the variation range of the voltage at the data lines DL1, . . . , DLm may not be too large. By controlling the voltage swing the charge share circuit may reduce power consumption. In a charge sharing operation, the charge share circuit may allow the data lines DL1, . . . , DLm to be electrically connected. In some systems the data lines are connected to each other at a high level period of the source output enable signal /SOE, so that the data lines DL1, . . . , DLm have an average level of the voltages supplied to the data lines DL1, . . . , DLm during a low level period of the previous source output enable signal /SOE.

In FIG. 3, the timing controller 230 generates the gate control signals that controls the gate driver 210 and the data control signals that control the data driver 220. The signals may be based on red (R) pixel data, green (G) pixel data, blue (B) pixel data, a horizontal synchronization signal Hsync, a vertical synchronization signal Vsync, and a clock CLK that may be received from an external source.

The gate control signals may have a gate start pulse GSP, a gate shift clock GSC, a gate output enable signal GOE, etc. The data control signals may have a source start pulse SSP, a source shift clock SSC, a source output enable signal /SOE, a polarity control signal POL, etc. A device that may vary the width of one or more (e.g. a train) of pulses may receive a source output signal /SOE to generate a second source output signal /SOE'. Some devices may vary the width of one or more pulses signal but not the height of the pulses. In FIG. 3, a pulse width controller 250 receives the source output enable signal (/SOE), and may vary the pulse width of the source output enable signal (/SOE) to provide another source output enable signal (/SOE') that may have some varied pulse widths. The pulse width controller 250 receives red pixel data, green pixel data, and blue pixel data corresponding to respective gate lines GL1, GL2, . . . , and GLn in a unit of a gate line, and vary the pulse width of the source output enable signal (/SOE). The variation may be based on an average or a weighted average of the data signal of the red pixel data, the green pixel data, and the blue pixel data of the respective gate lines.

Figure 4:
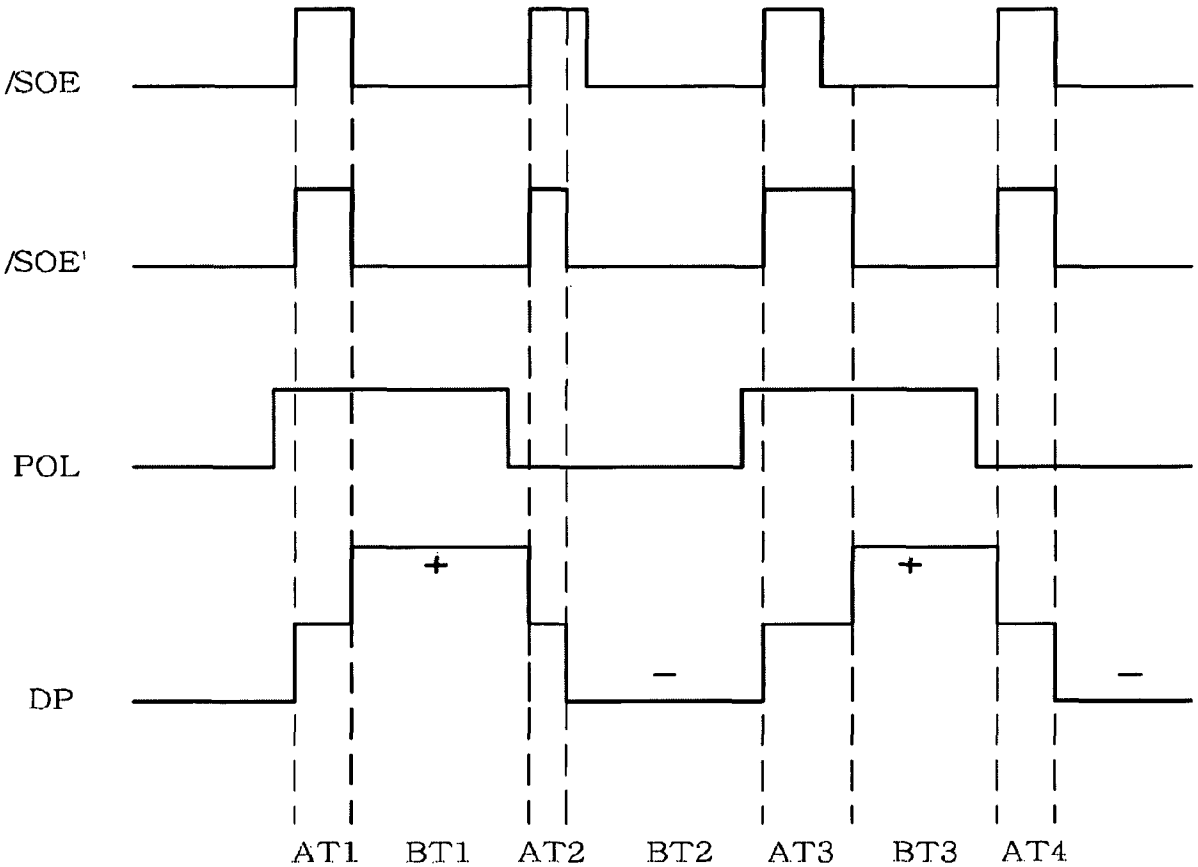
FIG. 4 is a timing diagram illustrating a charge sharing method used in FIG. 3.

In FIG. 4, /SOE comprises a source output enable signal transmitted from the timing controller 230, the /SOE' comprises a source output enable signal that may have a pulse-time varied in some systems, by the pulse width controller 250, and DP comprises an output of the data driver 220. A pre-charge voltage may be established at the data lines DL1, . . . , DLm during charge sharing periods (AT1, AT2, AT3 and AT4), and data voltages corresponding to the red pixel data, green pixel data, and blue pixel data transmitted from the timing controller 230.

In FIGS. 3 and 4, the data driver 220 performs the charge sharing during the high level period of the source output enable signal (/SOE') that may include some varied pulse widths. A pre-charge voltage may be reached at the data lines DL1, . . . , DLm, and provides the data voltages to the data lines DL1, . . . , DLm during the low level period of the source output enable signal (/SOE'). The high level periods of the source output enable signal (/SOE') correspond to the charge sharing periods (AT1, AT2, AT3 and AT4). The low level periods of the source output enable signal (/SOE') correspond to pixel charging periods (BT1, BT2 and BT3). Alternatively, the low level periods of the source output enable signal (/SOE') may correspond to the charge sharing periods (AT1, AT2, AT3 and AT4), and the high level periods of the source output enable signal (/SOE') may correspond to the pixel charging periods (BT1, BT2 and BT3).

When a pulse width of the source output enable signal (/SOE') varies based on pixel data (R, G, B), the power consumed during an inversion driving process may be reduced. For example, when a difference between a reference data signal and the pixel data (R, G, B) of a present frame is larger than a predetermined value, and thus voltage difference between a predetermined voltage (such as an average voltage, for example) and the data voltage charged at pixels of the present frame increases, the pulse width of the source output enable signal (/SOE) increases (refer to the period AT3 of FIG. 4). At this stage the charge sharing time increases.

The reference data signal may correspond to an average value of data signals (for example, data voltages) of one, some, or all frames or a modal value among the data signals of all frames. The pulse width of the source output enable signal (/SOE) may be based on the reference data signal.

In another example embodiment, when difference between the pixel data (R, G, B) corresponding to k-th gate line of a reference frame and the pixel data (R, G, B) corresponding to k-th gate line of a present frame is larger than a predetermined value, the pulse width of the source output enable signal (/SOE) increases (refer to the period AT3 of FIG. 4). At this state, the voltage difference between an average voltage of the data voltage charged at the pixels coupled to the k-th gate line of the reference frame and an average voltage of the data voltage charged at the pixels coupled to the k-th gate line of the present frame is larger than a predetermined value, and therefore, the pulse width of the source output enable signal (/SOE) increases. At this stage the charge sharing time increases.

In another example embodiment, when the difference between the pixel data (R, G, B) corresponding to k-th gate line of a present frame and the pixel data (R, G, B) corresponding to (k+1)-th gate line of the present frame is larger than a predetermined value, the pulse width of the source output enable signal (/SOE) increases (refer to the period AT3 of FIG. 4). At this state, the voltage difference between an average voltage of the data voltage charged at the pixels coupled to the k-th gate line of the present frame and an average voltage of the data voltage charged at the pixels coupled to the (k+1)-th gate line of the present frame is larger than a predetermined value, and therefore, the pulse width of the source output enable signal (/SOE) increases. At this stage the charge sharing time increases.

The period of time that a pulse width increases may be determined so that enough pixel charging time (BT1, BT2 and BT3) is provided so that a data voltage level or predetermined data voltage level may be reached. When the difference between a reference data signal and the pixel data (R, G, B) of a present frame is smaller than a predetermined value, and thus the charge sharing operation is not required, the pulse width of the source output enable signal (/SOE) decreases. (refer to the period AT2 of FIG. 4).

In another example embodiment, when difference between the pixel data (R, G, B) corresponding to k-th gate line of a reference frame and the pixel data (R, G, B) corresponding to k-th gate line of a present frame is smaller than a predetermined value, the pulse width of the source output enable signal (/SOE) decreases (refer to the period AT2 of FIG. 4). In another example embodiment, when difference between the pixel data (R, G, B) corresponding to k-th gate line of the present frame and the pixel data (R, G, B) corresponding to (k+1)-th gate line of the present frame is smaller than a predetermined value, the pulse width of the source output enable signal (/SOE) decreases (refer to the period AT2 of FIG. 4).

The pulse width of the source output enable signal (/SOE) may not always be fixed but may vary depending upon the pixel data (R, G, B). Specifically, the charge sharing period (AT1, AT2, AT3 and AT4) and the pixel charging period (BT1, BT2 and BT3) may vary depending upon the pixel data (R, G, B). Therefore, the swing range of the data voltages of each frame may be reduced by establishing or attaining the pre-charge voltage levels, which may be established at the data lines DL1, . . . , DLm.

In some systems, the source output enable signal (/SOE') having the varied pulse width is used as a reference signal of the pre-charge voltage and the data voltages that are the transmitted from the data driver 220. In these systems, a varied pulse width of the source output enable signal (/SOE') may be used to stabilize the data driver 220.

Figure 7:
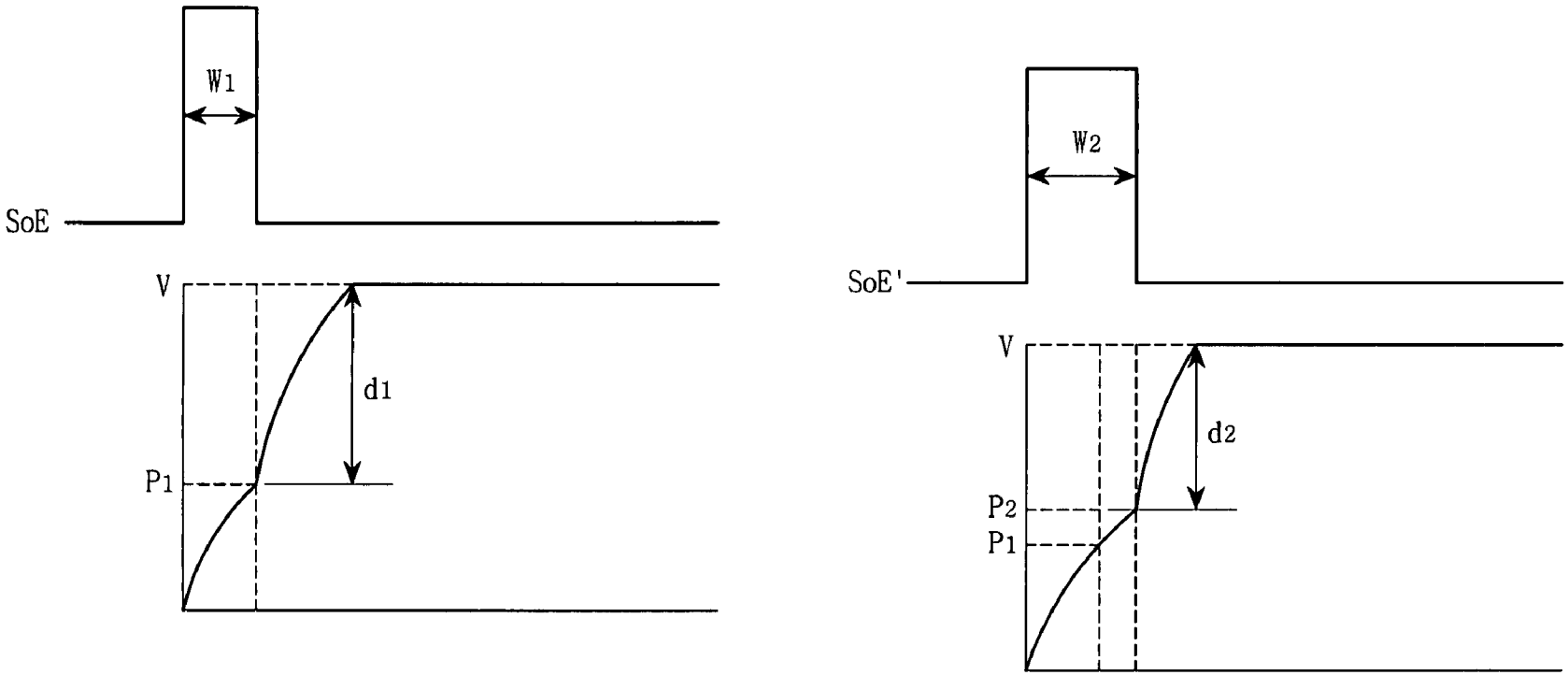
FIG. 7 is a signal diagram of a first and a second source output enable signal and corresponding charging diagrams.

In some systems, the heat created by the difference between a pre-charge voltage and a data voltage in systems that use the source output enable signal (/SOE) that always having fixed pulse, may be mitigated and the operational characteristics may be enhanced by varying some or all of the pulse width of the source output enable signal (/SOE'). In those instances when the positive pulse width may be greater than other source output enable signals (W2>W1), the pre-charge level shared between the data lines will reach a higher level (P2) as shown in FIG. 7. An increased pre-charge level (P2) reduces the voltage swing to the positive rail and thus reduces the power consumed by some devices. The difference in power consumption is reflected as the difference between d1 and d2. When the pulse width is smaller, the pre-charge voltage will be smaller, which reduces the power consumed by some devices when the voltage swings to the negative rail. The variations in pulse widths may depend upon the pixel data (R, G, B).

The pulse width controller 250 may comprise an integrated circuit or may comprise separate circuits from the timing controller 230 and the data driver 220. Alternatively, the pulse width controller 250 may be a unitary part of or may be integrated within the timing controller 230 or may be a unitary part of or may be integrated within the data driver 220. The voltage level and the pulse width of the source output enable signal (/SOE) may be controlled by external sources.

The polarity of the DP, which is transmitted from the data driver 220, is controlled by the polarity control signal POL provided from the timing controller 230 in some systems. The variation of the polarity of the DP leads to the variation of the swing range of the DP. The data driver 220 may also perform charge sharing based on the source output enable signal (/SOE'). The source output enable signal (/SOE') may have some varied pulse widths that may vary with the polarity control signal.

Figure 5:
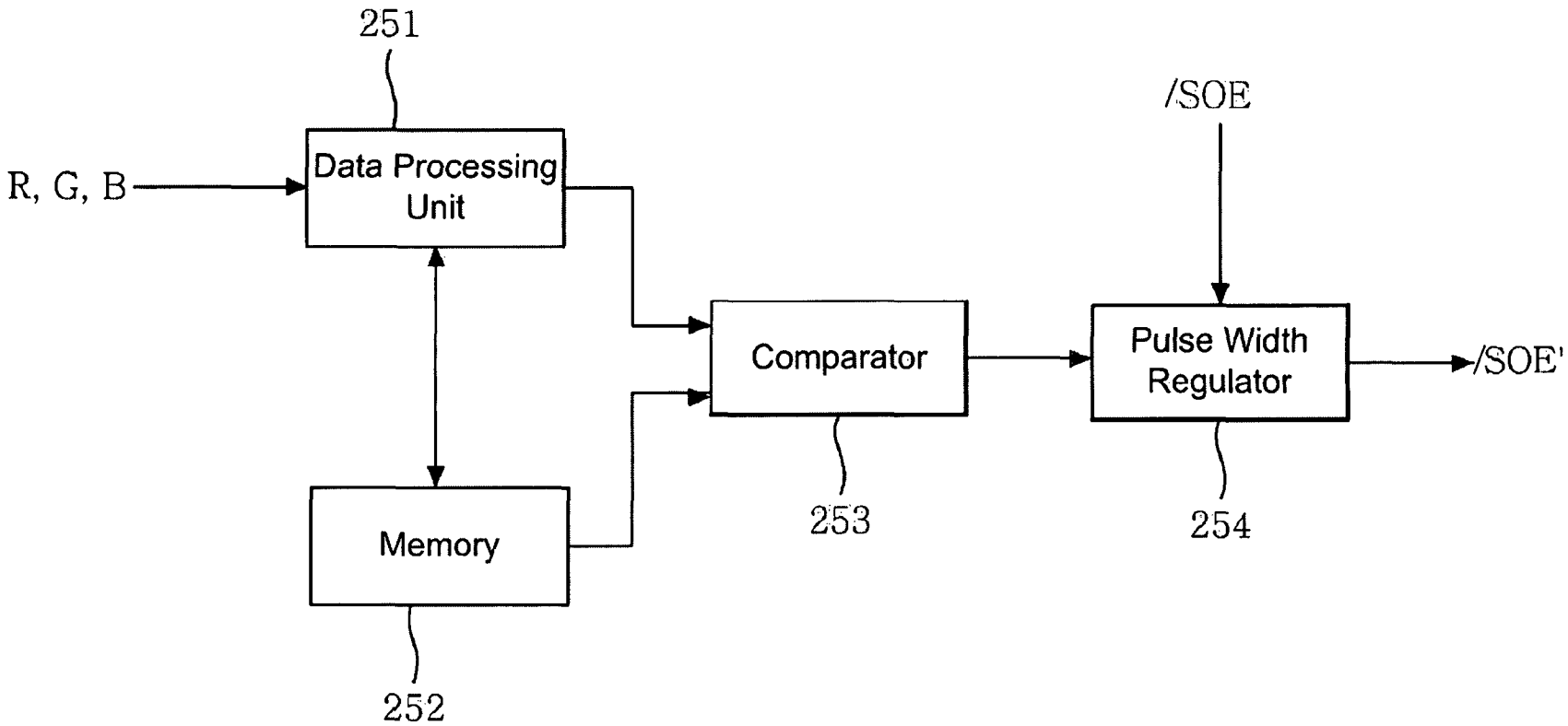
FIG. 5 is a block diagram of the pulse width controller of FIG. 3.

In FIG. 5, the pulse width controller 250 includes a data processing unit 251, a memory 252, a comparator 253, and a pulse width regulator 254. The data processing unit 251 receives red pixel data (R), green pixel data (G) and blue pixel data (B) corresponding to respective gate lines GL1, GL2, . . . and GLn in a unit of a gate line and may obtains an average data signal of the respective gate line. The memory 252 stores the reference data signal and the average data signal of the respective gate line in a unit of a frame. The reference data signal may correspond to an average value of data signals (for example, data voltages) of all frames, nearly all of the frames, or a modal value among the data signals of all frames. The pulse width of the source output enable signal (/SOE) may be determined by the reference data signal.

In FIG. 5 a device that compares two input signals and indicates which is higher, such as a comparator 253 compares the reference data signal to an average data signal of a respective gate line of the present frame to generate the pulse width control signal. In one embodiment, when difference between an average value of data signal corresponding to the k-th gate line of the reference frame and an average value of data signal corresponding to the k-th gate line of the present frame is larger than a predetermined value, the comparator 253 generates the pulse width control signal that increases the pulse width of the source output enable signal (/SOE). When the difference between an average value of data signal corresponding to the k-th gate line of the reference frame and an average value of data signal corresponding to the k-th gate line of a present frame is smaller than the predetermined value, the comparator 253 generates a pulse width control signal that decreases the pulse width of the source output enable signal (/SOE). The pulse width control signal increase or decrease the pulse width of the source output enable signal (/SOE) based on the difference between the average value of the data signal corresponding to the k-th gate line of the reference frame and the average value of the data signal corresponding to the k-th gate line of the present frame.

A pulse width of the source output enable signal (/SOE) increases accordingly as the difference between the average value of the data signal corresponding to the k-th gate line of the reference frame and the average value of the data signal corresponding to the k-th gate line of the present frame increases in some systems. The pulse width of the source output enable signal (/SOE) decreases accordingly as the difference between the average value of the data signal corresponding to the k-th gate line of the reference frame and the average value of the data signal corresponding to the k-th gate line of the present frame decreases in some systems.

In another embodiment, when the difference between an average value of a data signal corresponding to the k-th gate line of a present frame and an average value of data signal corresponding to the (k+1)-th gate line of the present frame is larger than a predetermined value, the comparator 253 generates the pulse width control signal that increases the pulse width of the source output enable signal (/SOE). When the difference between an average value of data signal corresponding to the k-th gate line of the present frame and an average value of data signal corresponding to the (k+1)-th gate line of the present frame is smaller than the predetermined value, the comparator 253 generates the pulse width control signal for decreasing the pulse width of the source output enable signal (/SOE).

The pulse width regulator 254 may receive the source output enable signal (/SOE) from the timing controller 230, and may vary the pulse width of the source output enable signal (/SOE) in response to the pulse width control signal transmitted form the comparator 253 to generate the source output enable signal (/SOE') having the varied pulse width.

Figure 6:
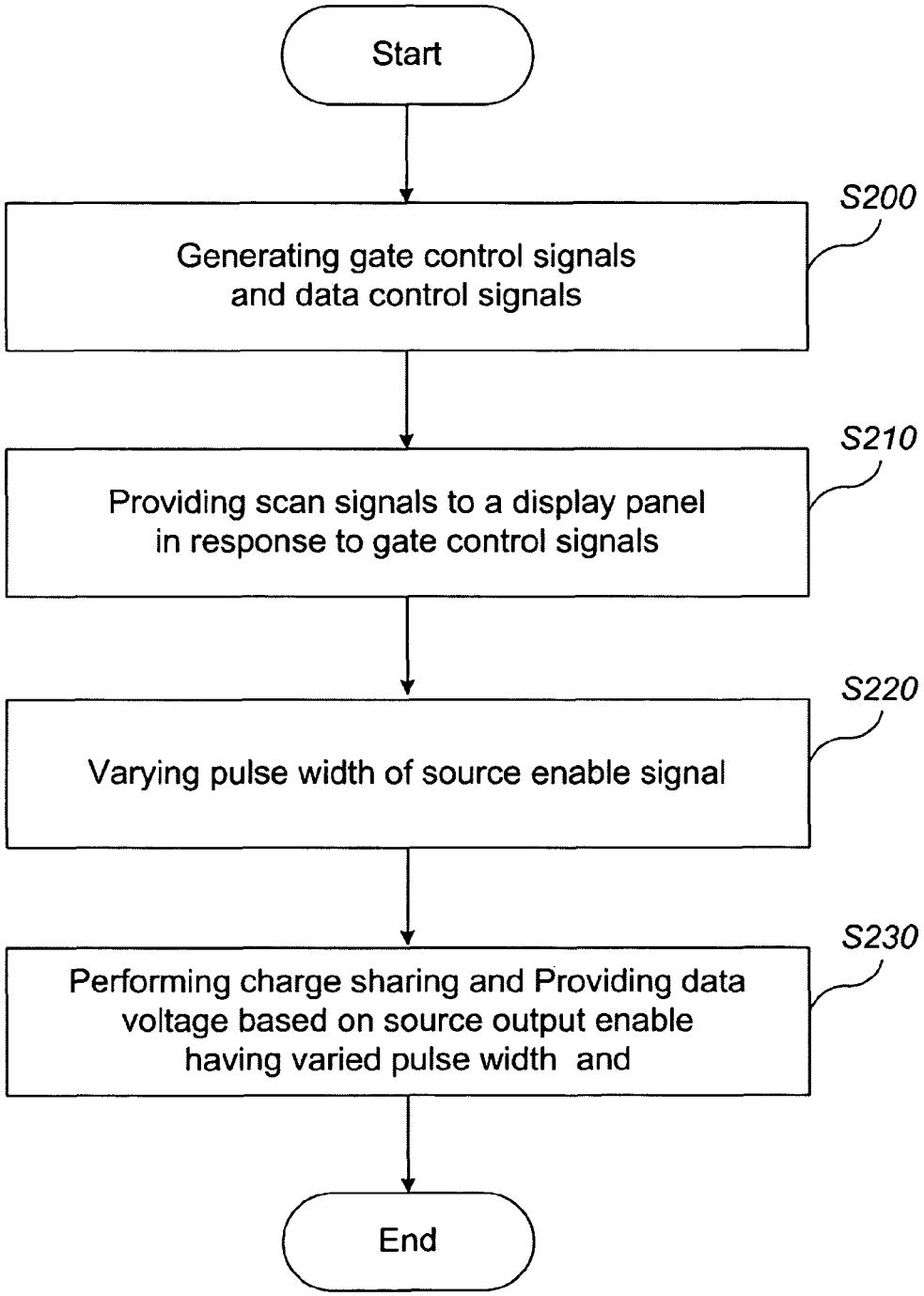
FIG. 6 is a flow chart of a method for driving the liquid crystal display.

In act S200 of FIG. 6, the timing controller 230 generates gate control signals for controlling the gate driver 210, and data control signals for controlling the source driver 220. The data control signals may include the source output enable signal (/SOE) and the polarity control signal POL. In act S210, the gate driver 210 provides a plurality of scan signals to the gate lines GL1, GL2, . . . , GLn of the liquid crystal panel 200 in response to the gate control signals that may occur sequentially. In act S220, the pulse width controller 250 varies the pulse width of the source output enable signal (/SOE). In some methods the pulse width controller 250 receives red pixel data, green pixel data and blue pixel data corresponding to respective gate lines GL1, GL2, . . . , and GLn in a unit of a gate line. The method varies the pulse width or pulse-time of the source output enable signal (/SOE) based on predetermined value such as an average value of the red pixel data, the green pixel data and the blue pixel data. The data driver 220 may adjusts the charge sharing period (AT1, AT2, AT3 and AT4) and the pixel charging period (BT1, BT2 and BT3). In some systems, the data driver 220 provides the pre-charge voltage to the data lines DL1, . . . , DLm during a high level period of the source output enable signal (/SOE') having the varying pulse width, or alternatively, provides the pre-charge voltage to the data lines DL1, . . . , DLm during a low level period of the source output enable signal (/SOE') having the varying pulse width.

Since the polarity of the data voltage is periodically changed when an inversion driving method is used, the data driver 220 receives the polarity control signal POL generated from the timing controller 230 and controls the polarity of the pre-charge voltage and the data voltage so as to perform the charge sharing operation. Act 220 may include i) an act of receiving red pixel data, green pixel data and blue pixel data corresponding to respective gate lines GL1, . . . , GLn in a unit of a gate line to obtain a predetermined or an average data signal of the respective gate line, ii) an act of storing a reference data signal and the average data signal of the respective gate line, iii) an act of comparing the reference data signal with an average data signal of a respective gate line of a present frame to generate a pulse width control signal, iv) an act of varying the pulse width of the source output enable signal (/SOE) in response to the pulse width control signal to generate the source output enable signal (/SOE') having the varied pulse width. Act 220 may include more or fewer acts in alternative methods.

At act S230, the data driver 220 performs the charge sharing operation on the data lines DL1, . . . , DLm of the panel 200 based on the source output enable signal (/SOE') having the varying pulse width so that a pre-charge voltage is reached or nearly reached at the data lines DL1, . . . , DLm, and the data driver 220 provides the data voltages to the data lines DL1, . . . , DLm. The display device according to this embodiment varies the pulse width of the source output enable signal (/SOE) which may minimize heat generation and the deterioration of display that may be caused by high power consumption. The methods may effectively drive the display device.

It will be apparent to those skilled in the art that various modifications and variations can be made in the liquid crystal display and a method for manufacturing the same without departing from the spirit or scope of the invention. Thus, it is intended that the present invention cover the modifications and variations of this invention provided they come within the scope of the appended claims and their equivalents.

What is claimed is:

1. A display device comprising:

a display panel that has a plurality of pixels that are divided by a plurality of gate lines arranged in a first direction and a plurality of data lines arranged in a second direction substantially perpendicular to the first direction;

a timing controller configured to generate at least one gate control signal and a first source output enable signal;

a gate driver configured to provide the gate lines with a plurality of scan signals in response to the at least one gate control signal;

a pulse width controller configured to vary a pulse width of the first source output enable signal to generate a second source output enable signal that has a varied pulse width; and a data driver configured to output a data voltage to the data lines in response to a low level period of the second source output enable signal, and output a pre-charge voltage to the data lines in response to a pulse of the second output enable signal, wherein the pre-charge voltage is generated when the data lines are electrically connected to each other, wherein the second source output enable signal varies an output time of the data voltage and the pre-charge voltage from the data driver according to an average data of a present frame, wherein the pulse width of the second source output enable signal increases when a difference between a reference data and the average data is larger than a predetermined value, and the average data is obtained as an average value of data signals of pixels connected to a gate line or to a plurality of gate lines.

2. The display device of claim 1, where the pulse width controller includes:

a data processing unit that processes red pixel data, green pixel data and blue pixel data to obtain the average data;

a memory configured to store the reference data signal and the average datal;

a comparator configured to compare the reference data signal to the average data signal to generate a pulse width control signal; and a pulse width regulator configured to vary the pulse width of the first source output enable signal in response to the pulse width control signal to generate the second source output enable signal.

3. The display device of claim 2, where the reference data corresponds to an average value of data signals of one, some, or all frames, or a modal value among the data signals of all frames.

4. The display device of claim 1, where the timing controller generates a polarity control signal for controlling a polarity of the data voltages.

5. The display device of claim 1, where the pulse width controller comprises a unitary part of the timing controller.

6. The display device of claim 1, where the pulse width controller comprises a unitary part of the data driver.

7. The display device of claim 1, where the pulse width controller is separate from the timing controller and the data driver.

8. A method of driving a display device, the method comprising:

generating at least one gate control signal and a first source output enable signal;

providing a plurality of gate lines of a display panel with a plurality of scan signals in response to the at least one gate control signal;

varying a pulse width of the first source output enable signal to generate a second source output enable signal;

providing a pre-charge voltage to data lines of a display panel in response to a pulse of the second output enable signal, wherein the pre-charge voltage is generated when the data lines are electrically connected to each other, and providing data voltages to the data lines in response to a low level period of the second source output enable signal, wherein the second source output enable signal varies an output time of the data voltage and the pre-charge voltage from the data driver according to an average data of a present frame, wherein the pulse width of the second source output enable signal increases when a difference between a reference data and the average data is larger than a predetermined value, and the average data is obtained as an average value of data signals of pixels connected to a gate line of the display panel or to a plurality of gate lines of the display panel.

9. The method of claim 8, the varying a pulse width of the first source output enable signal to generate a second source output enable signal comprising:

receiving red pixel data, green pixel data and blue pixel data to obtain the average data; and varying the pulse width of the first source output enable signal based on the average data signal to generate the second source output enable signal.

10. The method of claim 8, the varying a pulse width of the first source output enable signal to generate a second source output enable signal comprising:

receiving red pixel data, green pixel data and blue pixel data to obtain the average data;

storing the reference data and the average data;

comparing the reference data with the average data signal to generate a pulse width control signal; and varying the pulse width of the first source output enable signal in response to the pulse width control signal to generate the second source output enable.

11. The method of claim 10, where the reference data corresponds to an average value of data signals of one, some, or all frames, or a modal value among the data signals of all frames.

12. The method of claim 8, further comprising generating a polarity control signal that controls a polarity of the data voltages and a polarity of the pre-charge voltage.

* * * * *